United States Patent [19]

Lundmark et al.

[11] 4,316,679

[45] Feb. 23, 1982

[54] GROUND STABILIZATION EQUIPMENT

[75] Inventors: Signar Lundmark; Leif Hällgren, both of Skellefteå, Sweden

[73] Assignee: Linden-Alimak AB, Skellefteå, Sweden

[21] Appl. No.: 29,765

[22] Filed: Apr. 13, 1978

Related U.S. Application Data

[63] Continuation of Ser. No. 845,611, Oct. 26, 1977, abandoned.

[30] Foreign Application Priority Data

Dec. 2, 1976 [SE] Sweden ..... 7613559

[51] Int. Cl.[3] ..... E02D 3/12

[52] U.S. Cl. ..... 405/303; 405/263; 405/269

[58] Field of Search ..... 405/233, 241, 258, 263, 405/266, 269, 303; 404/108

[56] References Cited

U.S. PATENT DOCUMENTS

| | | | |
|---|---|---|---|
| 3,200,599 | 8/1965 | Phares et al. | 405/241 |
| 3,255,592 | 6/1966 | Moor | 405/241 X |
| 3,967,912 | 7/1976 | Parker | 404/108 X |
| 4,058,986 | 11/1977 | Granholm | 405/269 |

*Primary Examiner*—David H. Corbin

*Attorney, Agent, or Firm*—Curtis Ailes

[57] ABSTRACT

In apparatus for injecting and mixing a ground stabilization agent into the material of the earth during the operation of an earth drill, a device is provided for generating signals indicative of the upward movement of the earth drill as the drill is withdrawn and while the stabilization agent is being introduced, and a weighing device is provided for constantly weighing the remaining supply of ground stabilization agent and for thereby measuring the weight of stabilization agent delivered to the ground, and a recorder is connected to receive signals from both of the devices for providing a graphic record of the stabilization agent delivered versus the upward travel of the earth drill.

3 Claims, 5 Drawing Figures

GROUND STABILIZATION EQUIPMENT

This is a continuation, of application Ser. No. 845,611 filed Oct. 26, 1977 now abandoned.

The present invention relates to an arrangement in connection with a mobile ground stabilization equipment including a traction and operating vehicle, an earth drill apparatus for injecting and mixing a ground stabilization agent into the earth material during operation of the earth drill, a supply tank for the ground stabilization agent, and a device for feeding out and portioning the ground stabilization agent into a conduit leading from the tank to the earth drill apparatus.

In the British pat. No. 1,234,604 a method for stabilizing especially cohesive soils with a binding agent, especially lime products, is described, wherein a tool designed as a drill head with an injection nozzle for the binding agent is introduced into the ground to the desired depth, whereupon the tool is withdrawn while binding agent under pressure is simultaneously fed through the nozzle openings. The ground material nearby the nozzle openings as thereby stirred by means of the drill head, so that the binding agent is mixed with the earth material. More specifically the tool is an earth drill of the rotating type with a drill head mounted on the end of a drill bar, the nozzle openings communicating with a feeding conduit for the binding agent extending through the drill bar. The binding agent is blown by means of pressurized air from a magazine or supply tank through a conduit to the drill head.

U.S. patent specification 3,200,599 discloses means allowing control and supervision of the pumping of grout into predrilled holes in the ground. The grout is pumped in successively as the drill is withdrawn, it being important that a determined pumping pressure should be maintained in every moment of the grout filling process in order to obtain the best result. For this object a pressure sensing device is used, which controls the upwardly directed movement of the drill and the grout pumping velocity. The quantity of grout pumped into the hole can be determined solely based upon the number of grout pump revolutions or turns during drill withdrawal, and the volume of grout pumped in one turn.

In an arrangement of the kind defined initially above, it has, however, turned out as essential to be able to exactly control and supervise the distribution in vertical direction of the lime quantity fed out and stirred into the ground over a large area.

It is therefore an object of the present invention to provide, in an arrangement of said kind a cheap, simple and reliable device, which permits continuous recording of the quantity and distribution of the binding agent injected into the ground, both vertically and horizontally over a large area.

The arrangement according to the invention is characterized by a device in the traction and operating vehicle for recording the amount and distribution of binding agent injected into the ground, comprising (a) a first device sensing and generating first signals at the passage of peripherally located indicating positions on a rotatable element included in the drive for the earth drill, the speed of said rotatable element depending upon the feeding movement of the earth drill, (b) a weighing device, included in the mobile equipment, on which the tank rests between vertical guide means and by means of which the contents of the tank are weighed and second signals representative of changes in said contents are generated, (c) a recorder in which two inputs are driven by the first and second signals, respectively, for providing a graphic representation illustrating the successive amounts of fed out binding agent per drilled length unit under ground level for successive holes, so that a picture of the binding agent distribution in vertical direction can be obtained over a large area.

The invention will now be described more closely below with reference to the drawings, on which FIG. 1 schematically in a side view illustrates a mobile ground stabilization equipment;

Figure 1:
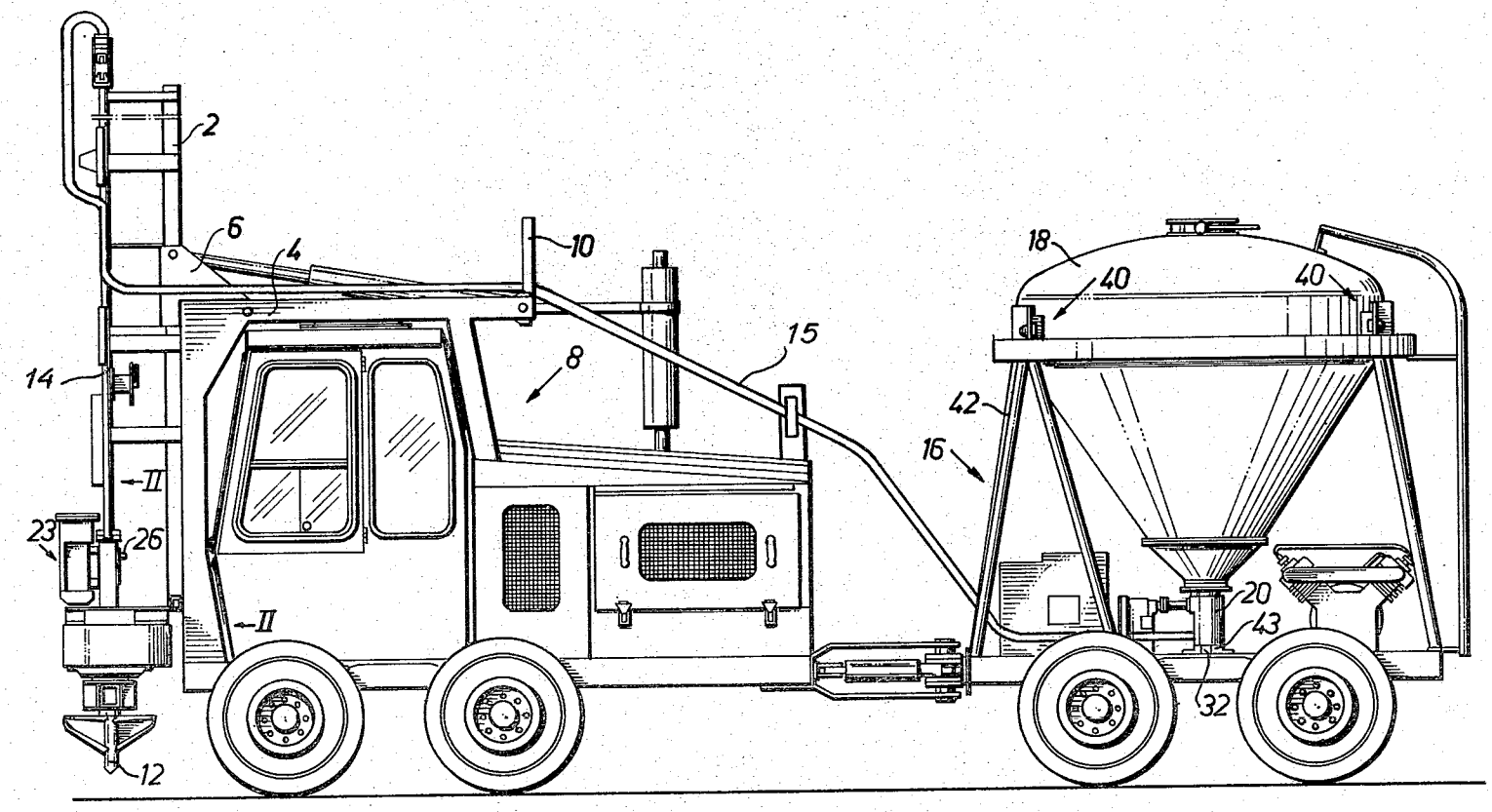

The ground stabilization equipment illustrated in FIG. 1 includes a lattice mast 2, which is carried at 4 by a hydraulic rocking lever system 6 mounted on a traction vehicle 8. By means of the rocking lever system 6 the lattice mast 2 can be swung rearwardly from the operational position shown in FIG. 1 over the vehicle to take a transport position against a support 10.

The lattice mast 2 forms guide means for an earth drill which is driven by an endless chain. The earth drill comprises a drill bar 14 carrying a drill head 12 at its lower end and containing an axial channel for delivery of pulverulent binding agent, e.g. lime, to the drill head 12, where outlets for the binding agent are provided. To the axial channel in the drill bar 14 leads a conduit 15 from a supply tank 18 for the binding agent. The tank 18 is located on a trailer vehicle 16 of the transport vehicle 8. In the bottom of tank 18 an outfeed device 20 for the binding agent to the conduit 15 is arranged.

The ground stabilization equipment described above is of the same type as the one described in U.S. patent application No. 579,430, filed May 21, 1975 now U.S. Pat. No. 4,058,986 for Ground Stabilizing Equipment, and assigned to the same assignee as the present application. Details of the outfeed device 20 as well as other details mentioned in the present description, but not shown on the drawings, are carried out in accordance with the teachings of that U.S. patent, which is incorporated herein by reference.

As explained in that patent, the outfeed device 20 is supplied with pressurized air by means of which the pulverulent binding agent is exhausted from the outfeed device 20 through the conduit 15 to the drill head 12.

Figure 2:
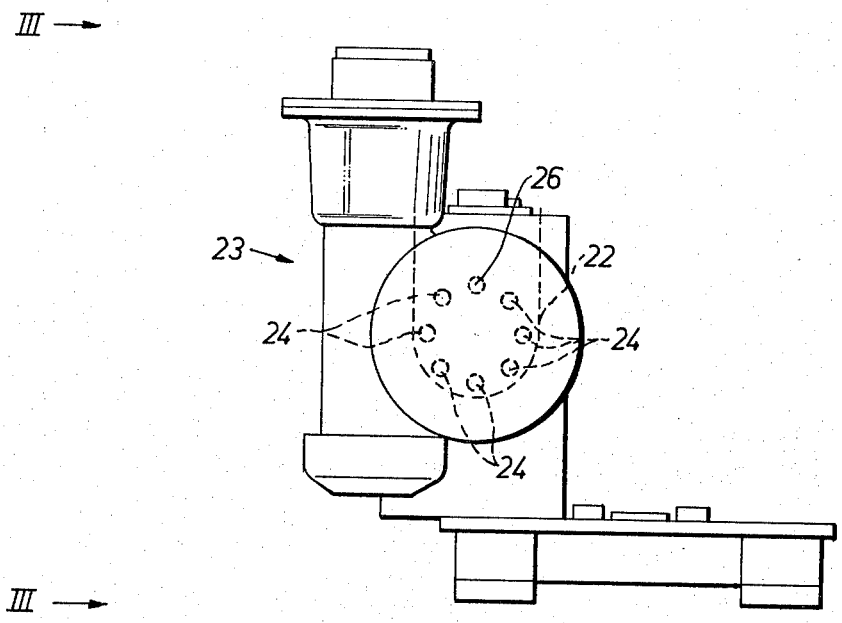
FIG. 2 shows a view in the direction of arrows II—II in FIG. 1 of a detail of the ground stabilization equipment.
Figure 3:
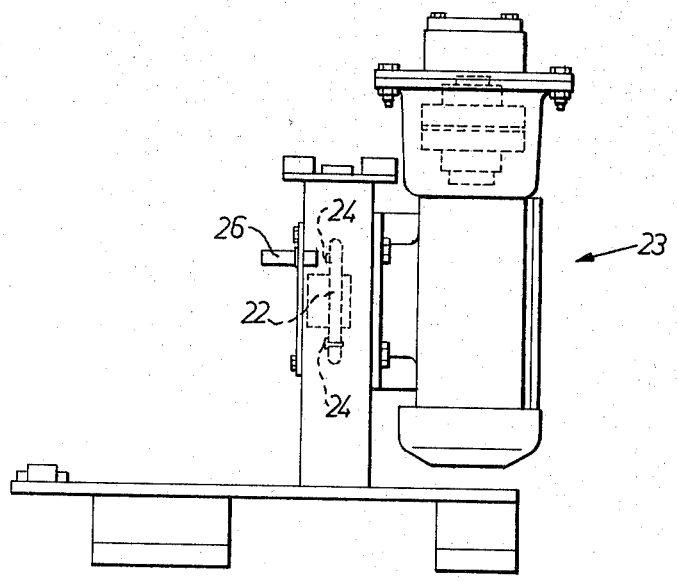
FIG. 3 shows a view in the direction of arrows III—III in FIG. 2.
Figure 4:
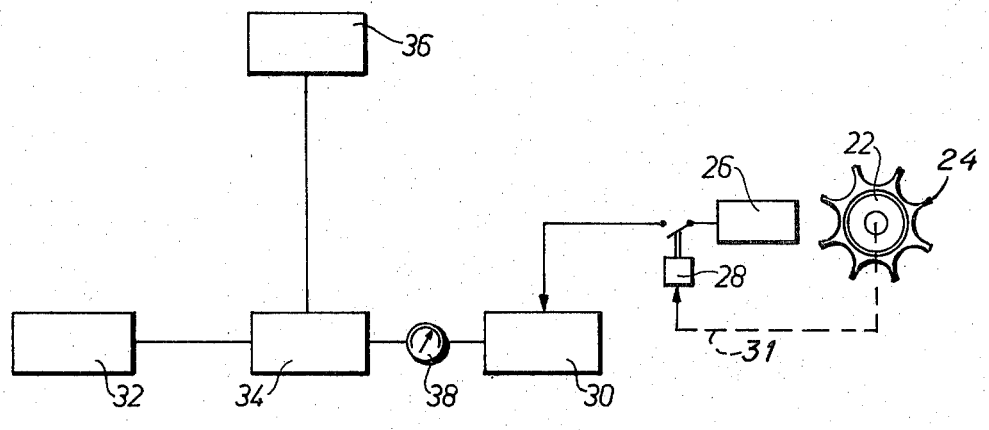
FIG. 4 is a block diagram of a measuring system according to the invention included in the ground stabilization equipment according to FIG. 1.

For feeding the drill bar 14 vertically a chain drive 22 (FIG. 2, FIG. 3 and FIG. 4) and an appurtenant driving device, indicated at 23, are provided. Around the periphery of the chain drive a number of regularly distributed metal bodies 24 are attached. A sensor 26 of the inductive type senses the successive passage of the metal bodies 24 and generates an impulse for each such passage. The output of the sensor or impulse generator 26 is connected via a pressure contact 28 for driving a step motor for the paper feed of a recorder 30, which is located in the cabin of the traction vehicle 8. The pressure contact 28 is mechanically actuable by the feed movement of the drill bar 14 so that it breaks the connection between the impulse generator 26 and the recorder 30, when the drill bar is fed downwardly, but closes it when the drill bar is fed upwardly. The coupling between the drill bar feed and the pressure contact switch 28 is shown schematically in FIG. 4 as a connection 31 between the switch 28 and the drill bar vertical chain drive 22. The function of closing switch 28 only during upward drill bar feed is a well known function, and details of that switching function operation therefore are not shown. By this means the impulses are received by the recorder only when the drill is fed upwardly and lime is fed out.

The storage tank 18 and the feeding device 20 (FIG. 1) rest on a load cell 32 on the trailer. The load cell 32 is connected to a bridge amplifier 34 (FIG. 4), which is connected to a circuit 36 for taring and calibration control, by means of which the tare weight of the lime tank 18 and feeding device 20 is balanced. To the output of the bridge amplifier 34 an instrument 38 is connected which indicates the total weight of the lime supply. The signal proportional to the weight of the lime supply is fed to an input of the recorder. Thus, changes of the lime supply are recorded along one axis of the recorder and along the other axis is recorded the distance done by the drill. The slope of the curve obtained on the recorder paper becomes a measure of the lime amount that has been fed out in kilograms per meter.

To allow for the weight determination described above the tank 18 with the feeding device 20 (FIG. 1) is movably guided vertically by means of rolls 40 bearing against the surface of the tank 18 and rotatably mounted in the frame 42 surrounding the tank on the carriage 16. The feeding device is guided between walls 43 mounted on the chassis of the trailer vehicle.

Figure 5:
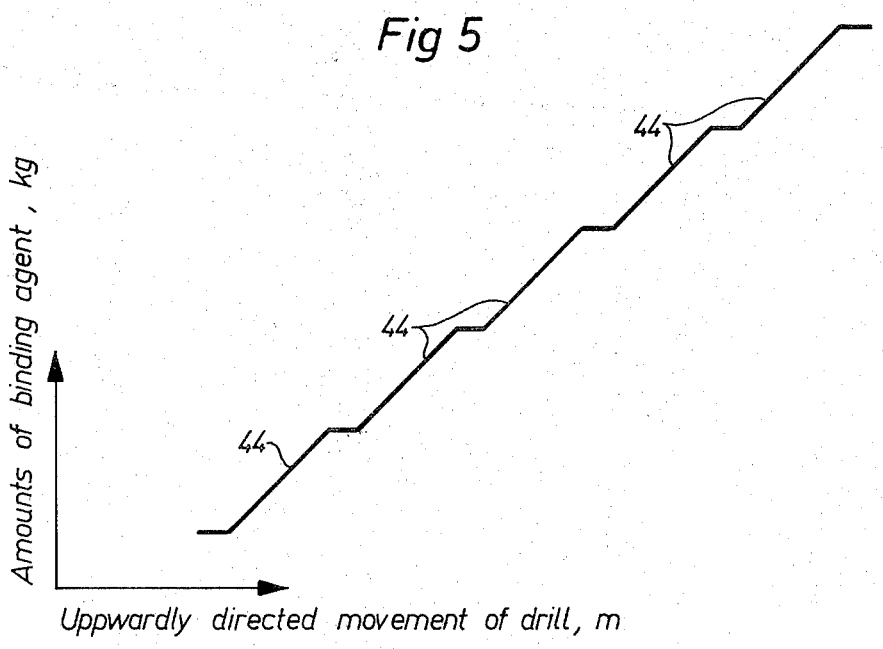
FIG. 5 illustrates an example of a recording obtained by the means of the system according to FIG. 4.

In FIG. 5 an example of the recorded diagram is illustrated. As seen it forms successive steps, where the sloping part 44 of the curve corresponds to the upwardly directed feeding movement of the drill, from the deepest position of a drill to a position where the feeding of binding agent ceases, whereupon the curve becomes horizontal indicating that the upwardly directed feeding movement of the drill continues a short distance to the top position thereof. A diagram is thus obtained that illustrates the quantity and the distribution of the binding agent injected into the ground, both vertically and horizontally over a large area.

In the above description the sensor or impulse transmitter 26, the load cell 32 and the recorder 30 have been assumed to be of a type well known to the man of the art and easily available on the market.

In short, however, the load cell can be of the known type comprising a load bearing metal body, on which four strain gauges are attached. The gauges are arranged in a bridge circuit connected to an output device, in the present instance the recorder. Compression of the body under load causes a microscopic deformation thereof which is sensed by the strain gauges and appears as an alteration of their electric resistances. The total resistance change varies linearly with the load and is converted into an output signal.

The inductive sensor works by means of an LC-oscillator circuit connected to a transistor or thyristor circuit.

If a metallic object approaches the sensor, the LC-circuit is so heavily damped that the oscillations of the device cease. Via a flip flop amplifier the transistor or thyristor circuit at the output of the sensor is triggered.

A number of load cell devices and sensors of the kind described are readily available on the market.

From the above it should be evident that the invention aims to solve the problem of recording the binding agent distribution in vertical direction under the ground level. This is possible only by accurately measuring successively fed out amounts of binding agent during the movement of the drill. This problem has, in accordance with the invention, the surprising solution that the binding agent tank is carried by a weighing device on the mobile equipment, by means of which changes in the weight of the contents of the tank are measured. Furthermore, a very accurate control of the recorder is obtained with regard to small changes of the level under ground of the drill by means of the sensor 26 and its mounting to sense the drill's movements.

What is to be claimed is:

1. A mobile ground stabilization equipment including a traction and operating vehicle, an earth drill apparatus including an earth drill head, for injecting and mixing a pulverulent binding agent into the earth material during operation of the earth drill head, a supply tank for the pulverulent binding agent, and a device for receiving pressurized air and for feeding out and portioning the pulverulent binding agent blown by the pressurized air into and through a conduit leading from the tank to the earth drill head and through the earth drill head, said equipment including means in the traction and operating vehicle for recording the amount and distribution of pulverulent binding agent injected into the ground, comprising (a) a first device sensing and generating first signals in response to the passage of peripherally located indicating position devices on a rotatable element included in the drive for the earth drill head, the speed of said rotatable element depending upon the feeding movement of the earth drill head, (b) a weighing device, included in the mobile equipment, on which the tank rests between vertical guide means and by means of which the contents of the tank are weighed and second signals representative of changes in said contents are generated, (c) a recorder in which two inputs are driven by the first and second signals, respectively, for providing a graphic representation illustrating the successive weights of fed out binding agent per drilled length unit under ground level for successive holes, so that a picture of the binding agent distribution in vertical direction can be obtained over a large area.

2. An arrangement according to claim 1, in which the feeding movement of the earth drill is obtained by means of an endless chain, and wherein said first device is a transmitter which senses the proximity and successive passage of uniformly distributed indicating position devices on one of the chain wheels of the chain drive and transmits an impulse for each such passage, said impulses driving the forward feeding of the recorder.

3. An arrangement according to claim 2, wherein there is provided a contact means between the recorder and the transmitter arranged to let through the impulses only during the upwardly directed feeding movement of the drill.

* * * * *